United States Patent [19]

Hoffmann et al.

[11] Patent Number: 4,522,316

[45] Date of Patent: Jun. 11, 1985

[54] CONTAINER FOR PLASTIC SUBSTANCES

[75] Inventors: Armin Hoffmann, Germering; Armin Herb, Peissenberg, both of Fed. Rep. of Germany

[73] Assignee: Hilti Aktiengesellschaft, Fürstentum, Liechtenstein

[21] Appl. No.: 489,850

[22] Filed: Apr. 29, 1983

[30] Foreign Application Priority Data

May 6, 1982 [DE] Fed. Rep. of Germany ..... 3217044

[51] Int. Cl.[3] ..... B65D 88/54

[52] U.S. Cl. ..... 222/327; 206/384

[58] Field of Search ..... 222/326, 327, 386, 386.5, 222/542, 325; 220/93; 206/817, 384

[56] References Cited

U.S. PATENT DOCUMENTS

| | | | |
|---|---|---|---|
| 2,855,130 | 10/1958 | Hosler | 222/327 |
| 3,272,401 | 9/1966 | Fendler et al. | 222/386 |
| 3,880,331 | 4/1975 | Perkins | 222/327 |
| 3,884,396 | 5/1975 | Gordon et al. | 222/327 |
| 4,217,995 | 8/1980 | Robillard | 222/327 |

FOREIGN PATENT DOCUMENTS

| | | | |
|---|---|---|---|
| 800607 | 5/1936 | France | 222/386 |
| 465157 | 12/1968 | Switzerland | 222/386 |

*Primary Examiner*—Joseph J. Rolla
*Assistant Examiner*—Kenneth Noland
*Attorney, Agent, or Firm*—Toren, McGeady, Stanger

[57] ABSTRACT

A container for a plastic substance includes an axially elongated sleeve defining a hollow space for holding the substance. An extrusion piston is slidably displaceable through the hollow space for extruding the substance out of a discharge outlet. The piston forms a closure for the hollow space. Before the substance is extruded from the sleeve, a sealing ring, inserted between the inside surface of the sleeve and the piston, prevents the penetration of air into the hollow space, and the loss of gases formed by the evaporation of solvents out of the hollow space.

9 Claims, 3 Drawing Figures

CONTAINER FOR PLASTIC SUBSTANCES

SUMMARY OF THE INVENTION

The present invention is directed to a container for a plastic substance, such as a plastic adhesive, a filling compound, a sealing compound or putty and includes an axially elongated substantially cylindrical sleeve with a discharge outlet or opening at one end and an extrusion piston located within the sleeve so that it can be axially slidably displaceable for extruding the substance through the discharge outlet.

Plastic single-component or multi-component substances are utilized chiefly in the construction industry, but also in other fields, for various purposes. To prevent the premature hardening of the plastic substances, it must usually be stored to prevent the inflow or outflow of gas. Generally, the sealing action is provided by packing the substance in a sleeve-shaped container with an extrusion piston positioned in the sleeve so that it is axially slidably displaceable. Usually, the outside diameter of the piston is overdimensioned relative to the inside diameter of the sleeve-shaped container. To limit the resistance to the slidable displacement of the extrusion piston within the sleeve-shaped container, the overdimensioning of the piston is kept very small relative to the container. With such relative dimensioning of the piston and the inside of the container, the solid components of the plastic substance are kept from escaping from the container. It is possible, however, that air may penetrate into the container and react with the plastic substance. As a result, a portion of the plastic substance may harden during its storage period in the container. Because of the hardening action, the extrusion of the substance out of the container will be impeded. In addition, it is also possible that the solvent in the plastic substance may evaporate and develop a considerable gas pressure. If such gases escape out of the container the substance may be rendered unusable.

To date, the known measures for preventing the penetration of air into and the escape of gases or vapors out of the container, such as by the use of sealing substance or a protective cap, have proven too expensive or ineffective.

Therefore, the primary object of the present invention is to improve the seal between the extrusion piston and the container without significantly increasing the resistance to the displacement of the piston. Such a seal improves the storage conditions for the plastic substance within the container.

In accordance with the present invention, a sealing ring is provided between the outer surface of the extrusion piston and the inner surface of the sleeve forming the container so that the end of the sleeve opposite the discharge outlet can be closed off against any inflow or outflow of gas.

Accordingly, the sealing ring is inserted between the extrusion piston and the sleeve wall and it is displaceably arranged at least relative to the piston. When the extrusion piston is pushed toward the discharge outlet and the displacement of the substance out of the container is commenced, the piston is separated from the sealing ring. As a result, during the continued sliding displacement of the piston, the sealing ring has no influence on it. Therefore, the sealing ring acts only as a static seal while the plastic substance is stored, that is, before the commencement of the discharge of the substance out of the container.

In one embodiment, the sealing ring can remain in the end of the container and be separated from the piston merely by moving the piston out of contact with the ring. When the initial displacement of the extrusion piston takes place, however, a certain amount of resistance is developed against its movement and such resistance must be overcome to effect the separation of the piston from the sealing ring. Accordingly, in another embodiment, the sealing ring is arranged so that it can be displaced relative to the piston and the sleeve. In this embodiment, the sealing ring is removed from the end of the container before the commencement of the plastic substance extrusion operation. In this embodiment, the resistance to the slidable displacement of the piston remains constant during the extrusion operation.

In principle, the sealing ring can be constructed as desired. In one embodiment, the sealing ring, formed as a type of O-ring, with a corresponding choice of material, can be inserted into a recess provided for it. In an advantageous arrangement, the cross-section of the sealing ring is reduced in the direction toward the discharge outlet from the container. With such a cross-sectional form, the sealing ring can be pressed between the piston and the inside surface of the sleeve as a kind of wedge. As a result, the sleeve wall is forced outwardly and the piston is pressed inwardly.

A simple arrangement of the piston and the sleeve, as well as the sealing ring itself, is achieved in a further development of the invention where the outer surface of the sealing ring is frusto-conically shaped converging inwardly in the direction in which the piston extrudes the substance from the container. The frusto-conical configuration of the outer side of the sealing ring facilitates its introduction between the piston and the inside surface of the sleeve. During insertion of the sealing ring, the sleeve wall is pressed radially outwardly. Accordingly, the sealing surface between the sealing ring and the sleeve is frustoconical and affords a good sealing action. Further, the sealing surface between the sealing ring and the extrusion piston can also be frustoconically shaped or a cylindrical surface can be used.

During its placement, the sealing ring is pushed in between the sleeve and the extrusion piston. To assure that the sealing ring is always pushed in the required distance, it is advantageous to provide a stop shoulder on the inside surface of the sleeve against which the leading end of the sealing ring contacts when it is in final position. The stop shoulder, in addition to limiting the insertion of the sealing ring, can provide another function. This second function is that the sealing ring is held by the stop shoulder when the extrusion piston is pushed forwardly into the sleeve toward the discharge outlet. Accordingly, the piston is separated from the sealing ring by merely pushing it in the forward direction.

In one embodiment the sealing ring can be retained in the container and the piston can be separated from it merely by pushing the piston in the forward direction. As mentioned above, the initial displacement resistance of the extrusion piston can be high. At the same time, it is difficult to remove the sealing ring located between the piston and the sleeve without damaging the piston or the sleeve. To assist in the removal of the sealing ring, it is advisable to provide a tab on the ring for facilitating its removal. The tab can be formed integrally with the sealing ring or it can be adhered to it or cast along with the ring. The sealing ring is removed from the container by pulling on the tab. If necessary, the sealing ring can be provided with several such tabs.

To facilitate the removal of the sealing ring it can also be formed integrally with a cap-shaped protective cover. In this arrangement, the sealing ring is removed along with the protective cover before the commencement of the extrusion operation. In particular, a cap-shaped protective cover prevents dirt from penetrating into the extrusion piston which usually is formed as a hollow member. In addition, unintentional displacement of the piston is prevented by the protective cover.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
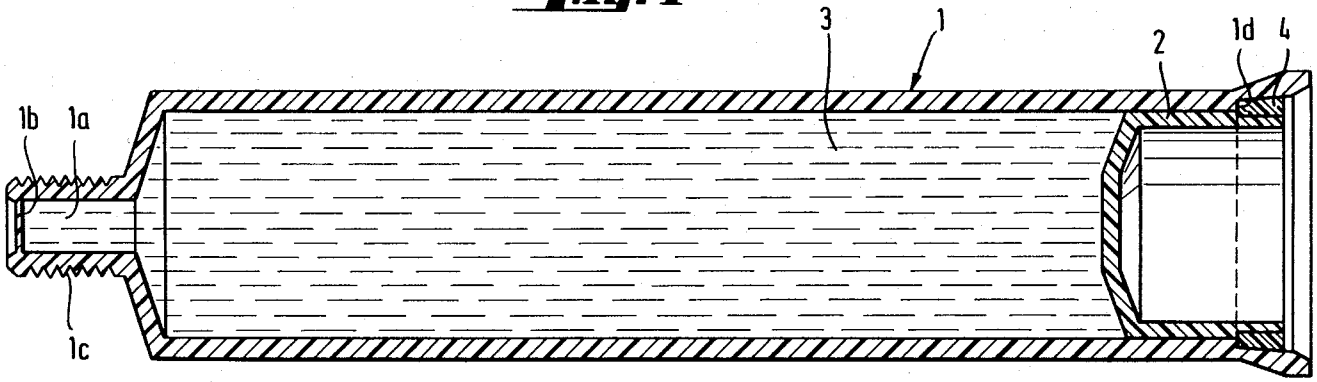
FIG. 1 is an axially extending cross-sectional view of a first embodiment of a container according to the present invention.

In FIG. 1 a container for a plastics substance, such as a plastic adhesive, a filling compound, a sealing compound, or putty is formed by an axially elongated generally cylindrically shaped sleeve 1. As viewed in FIG. 1, the sleeve 1 has a first end at its left end and a second end at its right end. An extrusion piston 2 is shown inserted into the second end of the sleeve and it is arranged so that it can be slidably displaced, through the hollow space within the sleeve containing the substance 3, toward the first end. At its first end, the sleeve 1 has a discharge opening or outlet 1*a*. The discharge outlet 1*a* is closed by a destructible membrane 1*b*. The outside surface of the container along the discharge outlet 1*a* contains a thread 1*c* for receiving a removable discharge nozzle. The substance 3 fills the hollow space within the sleeve 1 from the membrane 1*b* to the transverse surface of the piston 2. As viewed in FIG. 1 the container is in the storage condition, that is, in the condition prior to the commencement of the discharge of the plastic substance out of the container. To start the discharge of the plastic substance, the membrane 1*b* is broken. The second end of the sleeve, that is the opposite end from the discharge opening 1*a*, is closed by the extrusion piston 2. A sealing ring 4 is inserted between the outer surface of the piston 2 and the inner surface of the sleeve 1. The sealing ring is in contact with the trailing end of the piston 2, that is the end which trails in the extrusion direction when the piston is moved toward the discharge outlet 1*a*. The radially outer surface of the sealing ring is frusto-conically shaped and tapers inwardly in the direction toward the first end of the container. When the sealing ring is pressed between the facing surfaces of the sleeve and the piston, the wall of the sleeve is forced radially outwardly due to the frusto-conical configuration of the ring. As the ring 4 is inserted, its leading or forward end contacts a stop shoulder 1*d* formed by the stepped surface in the sleeve at the second end of the container. When the extrusion piston 2 is pressed toward the discharge outlet 1*a*, the sealing ring 4 is prevented from movement in the same direction by the stop shoulder 1*d*. Accordingly, the resistance to the slidable displacement of the piston 2 is influenced by the sealing ring 4 only at the very outset of the plastic substance extrusion operation.

Figure 2:
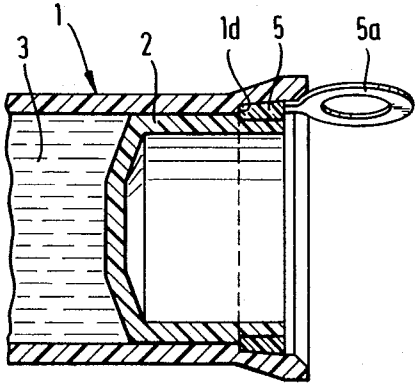
FIG. 2 is a partial sectional view, similar to FIG. 1, illustrating another embodiment of the present invention.

To prevent the resistance to sliding displacement of the extrusion piston 2 from becoming too great, it is advantageous if the sealing ring is removed from the second end of the container at the commencement of the extrusion operation. For removal of the sealing ring the embodiment in FIG. 2 is advantageous where the sealing ring 5, in generally the same form as sealing ring 4, is provided with a tab 5*a* connected to the sealing ring. Accordingly, the sealing ring 5 can be removed merely by pulling on the tab 5*a* in the direction out of the second end of the container. The resistance to the sliding displacement of the extrusion piston 2, relative to the inner surface of the sleeve 1, remains constant from the outset of the extrusion operation. In this second embodiment, the sealing ring 5, when initially introduced between the piston 2 and the sleeve 1, is limited in its movement toward the first end of the container by the stop shoulder 1*d* on the sleeve.

Figure 3:
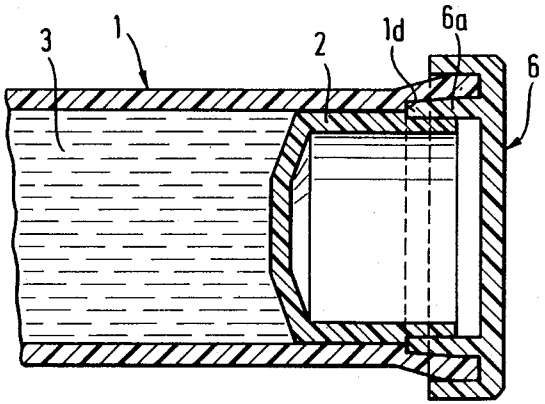
FIG. 3 is a sectional view similar to FIGS. 1 and 2 illustrating a third embodiment of a container in accordance with the present invention.

In the third embodiment of the invention shown in FIG. 3, the second end of the sleeve 1 is closed by a cap-shaped protective cover 6. The protective cover 6 is formed as a unit with sealing ring 6*a*, that is, the sealing ring and the cover form a monolithic member. When the protective cover 6 is removed from the second end of the sleeve 1, the sealing ring is also removed from between the inner surface of the sleeve 1 and the outer surface of the piston 2. In addition to the sealing action afforded between the sleeve and the piston 2 by the sealing ring 6*a*, the protective cover 6 also provides a mechanical protection of the container. Accordingly, dirt is prevented from entering into the cup-shaped portion of the extrusion piston 2. Further, the protective cover 6 prevents any accidental displacement of the extrusion piston while it is in position on the end of the container.

While specific embodiments of the invention have been shown and described in detail to illustrate the application of the inventive principles, it will be understood that the invention may be embodied otherwise without departing from such principles.

We claim:

1. A container for a plastic substance, such as a plastic adhesive, a filling compound, a sealing compound or putty, comprising an axially elongated sleeve having a first end and a second end spaced apart in the axial direction, said sleeve having an inner surface defining a hollow space for holding the substance, a discharge outlet located at the first end of said sleeve, said sleeve being open at the second end, an extrusion piston inserted into said sleeve and forming a closure for the hollow space inwardly of the second end of the sleeve, said piston having an outer surface in sliding contact with the inner surface of said sleeve and said piston forming a closure for the end of the hollow space closer to the second end of said sleeve, said extrusion piston arranged to be slidably displaced through the hollow space within said sleeve in the direction from the second end to the first end thereof for displacing the substance out of the hollow space in said sleeve through said discharge outlet, a sealing ring located within said sleeve between the inner surface thereof and the outer surface of said extrusion piston for forming a seal for the end of said hollow space closer to the second end of said sleeve, and said sealing ring is displaceable at least relative to said extrusion piston so that said extrusion piston can be displaced through said hollow space toward the first end of said sleeve in out-of-contact relation to said sealing ring while extruding the substance out of said space through said discharge outlet, said sealing ring has a cross-sectional configuration decreasing in the direction from the second end toward the first end of said sleeve.

2. A container, as set forth in claim 1, wherein said sealing ring is displaceably mounted in the second end of said sleeve relative to said extrusion piston and said sleeve.

3. A container, as set forth in claim 1 or 2, wherein said sealing ring has a radially outer surface and a radially inner surface and the radially outer surface of said ring is frusto-conically shaped tapering inwardly in the direction from the second end toward the first end of said sleeve.

4. A container, as set forth in claim 3, wherein the inner surface of said sleeve is stepped outwardly adjacent the second end thereof and forms a stop shoulder facing toward the second end, and the end of said sealing ring closer to the first end of said sleeve when said sealing ring is inserted into the second end of said sleeve bears against said stop shoulder.

5. A container, as set forth in claim 1 or 2, wherein a tab is secured to said sealing ring for removing said sealing ring when it is positioned between said sleeve and said extrusion piston.

6. A container, as set forth in claim 1 or 2, including a cap-shaped protective cover arranged to engage over the second end of said sleeve, and said sealing ring is formed integrally with said protective cover.

7. A container, as set forth in claim 1 or 2, wherein said discharge outlet has a smaller diameter than the diameter of said hollow space within said sleeve, said discharge outlet extends in the axial direction of said sleeve and the axially extending outer surface of said discharge outlet is threaded.

8. A container, as set forth in claim 1 or 2, wherein a destructible membrane is secured within said discharge outlet for forming a seal for said hollow space within said sleeve.

9. A container, as set forth in claim 1, wherein said extrusion piston is a cup-shaped member with the base of said cup-shaped member located inwardly from the second end of said sleeve when said extrusion piston is initially inserted into said sleeve.

* * * * *